US005317971A

United States Patent [19]

Deye, Jr. et al.

[11] Patent Number: 5,317,971

[45] Date of Patent: Jun. 7, 1994

[54] PIN REGISTER MOUNTER AND METHOD OF MOUNTING FLEXOGRAPHIC PLATES

[76] Inventors: Charles E. Deye, Jr., 5514 Pinecrest Dr.; Justin F. Michel, 5526 Pinecrest Dr., both of Cincinnati, Ohio 45238

[21] Appl. No.: 936,098

[22] Filed: Aug. 26, 1992

[51] Int. Cl.[5] ..... B41L 3/02

[52] U.S. Cl. ..... 101/486; 101/DIG. 36

[58] Field of Search ..... 101/378, 415.1, DIG. 36, 101/485, 486, 401.1; 33/614, 617, 618, 621

[56] References Cited

U.S. PATENT DOCUMENTS

| | | | |
|---|---|---|---|
| 3,186,336 | 6/1965 | Kirby | 101/486 |
| 4,019,434 | 4/1977 | Hoexter | 101/216 |
| 4,449,452 | 5/1984 | Mansell | 33/617 |
| 4,520,389 | 5/1985 | Hornschuh | 33/617 |
| 4,611,539 | 9/1986 | Ireton | 101/415.1 |
| 4,705,590 | 11/1987 | Vandenberg | 101/415.1 |
| 4,872,407 | 10/1989 | Banke | 33/617 |
| 5,058,287 | 10/1991 | Harley | 33/618 |

OTHER PUBLICATIONS

Article, "Registration System Reaps Benefits", *Paper, Film & Foil Converter*, Nov., 1987.

Instruction Manual, "Ready-Mount Pin Registration System", Cyrel®, #663393001, Jan., 1989.

Brochure, "Ready Mount System for Fast, Accurate Pin Register Plate Mounting", Cyrel®, #H-12705, Feb., 1989.

Brochure, "Cyrel® Registration System", E. I. du Pont de Nemours & Co. (Inc.), Printing Systems Division, Wilmington, DE 19898.

*Primary Examiner*—Edgar S. Burr
*Assistant Examiner*—Ren Yan
*Attorney, Agent, or Firm*—Wood, Herron & Evans

[57] ABSTRACT

Flexographic printing plates are mounted in precise registration on printing press cylinders for multicolor printing using a registration apparatus. In the preferred embodiment, the apparatus has a support on which a cylinder can be locked in fixed axial and circumferential position. A pair of pin holders slide on a bar parallel to the cylinder axis to set registration pins in precise positions relative to the surface of the cylinder. The bar moves toward the cylinder and places the pin bases on the cylinder surface so the plate is registered on the pins and adhered to the cylinder along the plate centerline and then across its back. The pin holders are set from a template that matches the plates. The locked pin holders and cylinder support allow additional plates to be similarly mounted on other cylinders in precisely corresponding positions, from their centerlines, with reduced error.

20 Claims, 4 Drawing Sheets

PIN REGISTER MOUNTER AND METHOD OF MOUNTING FLEXOGRAPHIC PLATES

The present invention relates to the mounting of printing plates, such as photopolymeric mats, to the cylinders of printing presses, and more particularly, to the mounting of different plates of a set of plates to multiple cylinders in precise registration with each other for high quality multiple color printing therewith.

BACKGROUND OF THE INVENTION

In multiple color printing, multiple step printing processes are employed in which different color components of multiple color images are separately imprinted onto the printing stock, usually paper, in a sequence of impressions with a series of separate plates or mats mounted onto separate cylinders of a press. Each of the mats imprints with an ink of a different color. Typically, four colors are employed. In such processes, it is important that the various plates be mounted on the cylinders in precise registration with each other so that the colors precisely align for the production of a high quality multicolor image.

In printing processes that use flexographic printing plates, or flexible photopolymer mats, the plates are usually secured to the cylinders with an adhesive such as a double backed tape, which holds the plates in position during printing. In mounting such plates, care must be taken to register the plates precisely in the same relative position on the respective cylinders. This registration process is often assisted with a mounting apparatus sometimes referred to as a registration system. These registration systems frequently employ pins that receive the mats by engaging a pair of holes made in the mats for registration purposes. The pins are locked into place on a mounting table, and the mats are transferred to the respective cylinders, one at a time, in what is intended to be the same relative position with respect to the respective cylinder. Inevitably, however, some error exists which will cause a slight misregistration of the colors on the printed work which detracts from or limits its quality.

Registration systems of the prior art have operated to engage the mats and transfer them to the print cylinders so as to register one edge of the plate along a line on the surface of the cylinder that is as close to being parallel to the axis of the cylinder, and as consistently located on the surface of the cylinder, as is possible with the equipment.

In such prior art systems, when the edge at one end of the mat is brought into contact with the cylinder surface, it is usually fastened to the surface first at this edge, and then progressively secured across its back surface to edge at its opposite end. In such a process, any error that exists in the registration of the first edge of the mat progressively increases around the cylinder with the distance from the edge of the mat that was first secured.

In one prior art system, it has been proposed to register the mats, begin securing the mats, from their centers. Such system employs pins mountable in holes predrilled into the cylinders to register with holes in the mats. This system has proved impractical because (1) it requires precise location of the holes in the mats to some predetermined positions or spacing, (2) it requires the drilling of multiple sets of holes in the cylinders to accommodate mats of different sizes, and (3) restricts the positioning of the holes in the mats to those of predetermined dimensions and spacing. These disadvantages make it most impractical to mount more than one mat at a time to a cylinder.

The systems of the prior art have been prone to error in the mounting of the plates on the cylinders, have required practice and skill in mounting the plates, and often consume excessive time and repetitive attempts to precisely mount the plates.

The prior art has not provided a flexographic mat registration system and method that is more precise and more practical than those set forth above. Accordingly, there is a need for a more precise, easier to use, and more flexible plate registration method and apparatus.

SUMMARY OF THE INVENTION

It is a primary objective of the present invention to provide a method and apparatus for more precisely registering flexographic mats, particularly mats for multiple color printing, onto the press rolls of a printing press. It is another objective of the present invention to provide a method and apparatus for registering flexographic plates to the cylinders of a printing press in a more flexible, reliable and less time consuming manner.

It is a more particular objective of the present invention to provide a flexible and efficient method and apparatus for precisely registering flexographic plates to printing press cylinders at the centers of the plates, and doing so quickly and precisely, and without restricting the allowable shapes, locations or spacings of registration elements such as the size, shape and location of registration pins. It is a further objective of the invention to provide such a method and apparatus that will not require modification of conventional printing press cylinders.

In accordance with the principles of the present invention, there is provided a method and apparatus by which registration elements are adjustably positioned relative to the surface of printing press cylinders to align with cooperating structure on the flexographic mats. Each plate has a printable image formed thereon in the same fixed relation to a centering line through the approximate center of the image. The elements cooperate with the cooperating structure on the mats to register the mats along a centerline thereof for repeatable positioning of the mat centerline along a precisely located imaginary mounting line on the cylinder surface. The relative positions of the elements with respect to cylinder support structure are maintained as the print cylinders are changed so that other mats of the same set can be applied in precisely the same registration with other cylinders of the press.

In accordance with the preferred embodiment of the present invention, there is provided a cylinder support having a moveable bar adjacent thereto that includes a track or registration edge aligned with the axis of a cylinder when the cylinder is mounted on the support. The edge is moveable toward and away from the axis of the cylinder mounted on the support and is kept parallel to the axis. The bar contains a pair of registration elements that each include a pin holder. The holders are slidable along the track and thereby adjustable and lockable to any of an infinite plurality of axial positions with respect to the cylinder. The holders carry mounting pins and, preferably, can removably receive the mounting pins that will precisely register a mat, by engaging and locating mounting holes in the mats, on the cylinder surface.

In accordance with the preferred embodiment of the invention, removable mounting pins are first positioned in a template, such as a mylar sheet, in holes therein, spaced and located at positions corresponding to the positions of registration holes in the mats. Preferably, the template is used in the process by which the holes are made in the mats, to insure that all of the mats of the set, and the registration pins that locate the mats on the cylinders, are correspondingly located and precisely spaced. The template is used to determine the positions on the bar to which the holders are located. Preferably, the template is draped over the cylinder, the bar is brought next to the cylinder surface, and the template is moved to bring the pins against the bar. This registers the template in the precise orientation with line of the pins along the bar and parallel to the axis of the cylinder. The guide holders, which are slidable along the bar, are slid into engagement with the pins held by the template where they are locked into place. The pins are then removed from the template and removably placed in the holders. preferably held thereto by loose clamps, magnets or other releasable holding techniques.

Preferably, the pins in holders have flat bases that face toward the surface of the cylinder. The cylinder surface is conditioned to secure the pin bases to it by, for example, the removal of a narrow portion of a backing from adhesive tape on the cylinder surface. Then, the bar is moved against the surface to bring the bases of the pins into contact with the adhesive tape, to which they stick and remain secured as the bar is withdrawn. Then, one of the mats is set on the cylinder surface, with a pair of holes on the mat centerline positioned on the pins, and tacked along a strip at its centerline. Then the pins are removed, the remainder of the backing is removed from the adhesive, and the mat is secured by pressing it against the adhesive progressively from the centerline toward the opposite ends of the mat.

The bar is provided with a motor drive that can be actuated to move it toward or away from the cylinder, preferably perpendicular to the axis. The bar is provided with a sensor that detects is proximity to the cylinder surface and signals a drive control circuit that automatically stops the bar. Thus, upon movement toward a cylinder, when the bar lies close to, but does not touch the cylinder surface, the bar is stopped. This feature is effective regardless of what the diameter of the cylinder might be.

The support is provided with a pair of rests that support opposite ends of the shaft of the cylinder in precise parallel relationship to the bar. The rests are moveable axially, parallel to the bar, to accommodate cylinders of differing widths and shifts of differing lengths. The rests also include adjustable ends guides to lock the cylinder in position axially. Also, the support may include an angular indexing mechanism to lock the cylinder circumferentially in preselected angular positions. The locks, as with the positions of the guide holders on the bar, remain locked in their adjusted positions so that, when the cylinders are changed for the mounting thereto of a different mat of the same set, the registrations of each mat with respect to the respective cylinders will be precisely the same. Similarly, the pin holders are set in place for the first mat and remain locked in the same place on the bar for all of the cylinders of the set.

By making it possible to easily register the mats to the cylinders along a line near the center of the mats, the realignment error is reduced and the multiplication of the error at points on the mat farther spaced from the registration line are less because the distance is less. The mounting of the plates in the precise registration proceeds quickly and positively, without the need to repeat the procedure to correct unacceptable errors. As a result, the registration process requires less time and labor and requires less experience and skill. Furthermore, the mats or plates can be placed on the cylinders an any of an infinite plurality of positions because the guides are not restricted to be located in a predetermined number of possible positions.

These and other objectives of the present invention will be more readily apparent from the following detailed description of the invention in which:

DETAILED DESCRIPTION OF THE DRAWING

Figure 1:
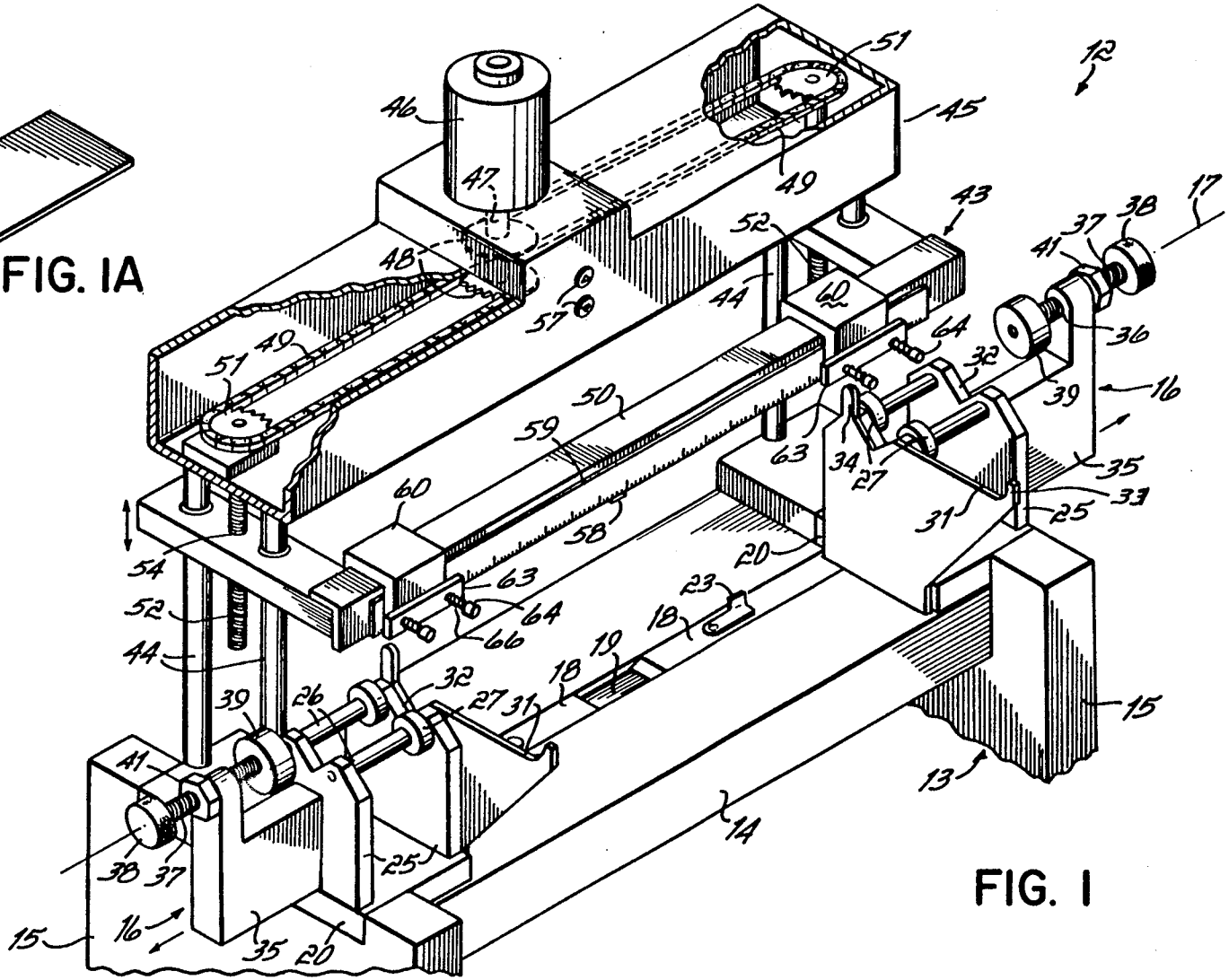
FIG. 1 is and isometric view, partially broken away, of a pin registration apparatus embodying principles of the present invention.

Referring to FIG. 1, a registration apparatus 12 for mountinq flexographic plates or mats to a printing press cylinder is illustrated. The apparatus 12 includes a floor standing base or frame 13 having a horizontal table 14 supported by a pair of vertical leg members 15 at opposite ends thereof. Depending on the size of the print rolls that the apparatus 12 is expected to handle, the base 13 may be designed to support several thousand pounds of weight.

On the upper surface of the table 14, in the preferred embodiment of the apparatus 12, are slidably mounted a pair of cylinder shaft end rests 16. The rests 16 are slidable to accommodate printing press cylinders of various widths. The rests 16 are transversely aligned on a transverse horizontal axis 17 and are constrained to slide on the table 14 parallel to the axis 17, by a key 18 that slides in a transverse horizontal keyway 19 in the top surface of the table 14. The keys 18 of the respective rests 16 are fixed to the lower surfaces of slide blocks 20 that constitute the bases of the rests 16. Each of the slide blocks 20 is provided with a locking knob or lever 23 for locking the rests 16 in position on the top of the table 14. The rests 16 may be linked together or geared in such a way as to require both to be equidistant from the center of the table 14, where balance of the cylinder weight is important, or, where unimportant, only one of the rests 16 need be moved or moveable.

Figure 2:
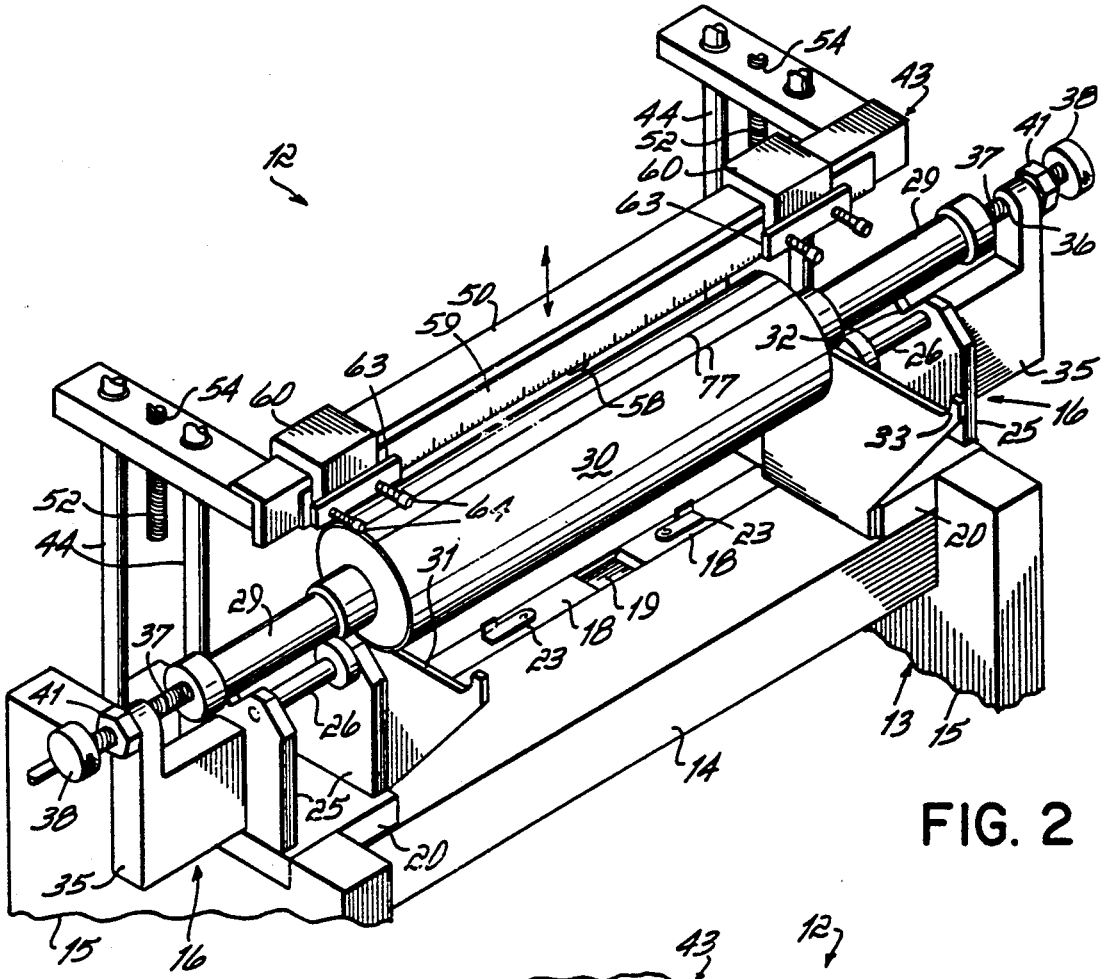
FIG. 2 is an isometric view of the embodiment of FIG. 1 with a printing cylinder supported thereon in preparation for the mountinq of a plate thereto.

The rests 16 each have, projecting upwardly from the slide block 20, a pair of transversely spaced parallel support plates 25. Rotatably mounted between each of the pairs of plates 25 is a pair of horizontally and transversely oriented roller shafts 26, each carrying a roller 27 and both at the same vertical height above the top of the table 14. The rollers 27 of each of the rests 16 are spaced at a distance sufficient for supporting one end of a shaft 29 of an anticipated size of a printing press cylinder 30, as illustrated in FIG. 2.

The innermost one of the plates 25 has an upper edge 31 positioned vertically in line with, or slightly above, the uppermost point on the surface of the rollers 27. Spaced midway between the axes of the rollers 27, in the edge 31, is a notch 32, which curves below the uppermost surface of the rollers 27 so that the shaft 29 of a print cylinder 30, when set vertically down onto the edge 31, will roll over the frontmost one of the rollers 27 of each rest 16 and drop into the notch 32, and upon the rollers 27 to be rotatably supported thereby. Each of the edges 31 has projecting upwardly therefrom a front stop 33 and a rear stop 34 so the roller can be set on the edges 31 and rolled into the notch 32 without rolling off the rests 16.

Extending outwardly in a transverse horizontal direction from the outermost one of the plates 25 of each rest 16 is a locking bracket 35 having a threaded bore 36 therethrough on the axis 17. Extending axially through the bore 36 is a threaded rod 37 having a knurled handle 38 on the outermost end thereof and a teflon disk 39 on the innermost end thereof. The rod 37 is axially adjustable to bring the disks 39 against the opposite ends of the shaft 29 to lock the shaft 29 in axial position on the base 13, and to insure that other identical cylinders of a set of cylinders will be set in exactly the same axial positions on the apparatus 12. The rods 37 may be locked in position by tightening lock nuts 41 against the outermost plate 25.

The rests 16 may also include a mechanism (not shown) for locking a cylinder 30 circumferentially in position and indexing the angular position of the cylinder 30 on the axis 17, for accurate positioning of multiple plates at precise positions with respect to each other on the cylinder 30.

Upstanding from the base 13, above the table 14, and fixed thereto is a registration assembly 43. The assembly 43 includes four vertical supports 44 having supported to the top thereof an elevator drive housing 45. The housing 45 has mounted on the top and at the center thereof an elevator drive motor 46 having a downwardly extending drive shaft 47 projecting into the housing 45. At the lower end of the shaft 47 is a pair of drive sprockets 48. Around each of the drive sprockets 48 extends a drive chain 49. Each of the chains 49 extends around an idler sprocket 51, at a respective one of the two opposite ends of the housing 45, fixed to the end of a drive screw 52. The drive screws 52 are rotatably mounted to the bottom of the housing 45 and extend vertically downwardly therethrough through a threaded hole 54 in a carrier 55 that rides vertically on the two of the supports 44 at the corresponding end of the housing 45.

The two carriers 55 have forwardly extending front ends that project over the axis 17 and have extending between the ends and parallel to, and approximately vertically above, the axis 17, a registration bar 50. The carriers 55 are vertically moveable on the supports 44 so as to raise and lower the bar 50, toward and away from the surface of a cylinder 30 supported on the rests 16, when the motor 46 is energized. The motor 46 is a reversible motor operatable by UP and DOWN buttons 57 on the front of the housing 45. The circuits (not shown) in which the buttons 57 are connected operate the motor 46 to move the bar 50 to a predetermined upper position with respect to the table 20 in response to the momentary depression of the UP one of the buttons 57, and to a predetermined lower position with respect to the surface of a cylinder 30 supported on the rests 16 in response to the momentary depression of DOWN one of the buttons 57. When the UP button 57 is pushed, the bar moves to the predetermined upper position and stops. When the DOWN button 57 is pushed, the bar moves to within a predetermined distance from the surface of the cylinder 30, preferably about 1/16th or ⅛th inch, and stops. The predetermined distance is controlled by a photoelectric proximity sensor 58, mounted on the bottom of the bar 50 at the center thereof. The bar 50 is provided with a scale 59 for facilitating the mounting or centering plates.

Mounted to the bar 50 to slide horizontally along the bar 50 are a pair of registration elements or blocks 60. Each of the blocks 60 includes a locking screw 61, better illustrated in FIG. 5, for locking the block 60 at any of an infinite number of intermediate positions along the continuous length of the bar 50. The screws 61 each drive a locking foot 62 against the bottom of the bar 50 to lock the respective block 60 in position to the bar 50.

On the front of each of the blocks 60 is mounted, in one preferred embodiment, a rectangular clamp 63. The clamp 63 of each block 60 is fitted over a pair of forwardly extending pins 64 on the front of the blocks 60. Each pin 64 has a forward head 65 thereon. Between the head 65 and the clamp 63 extends a compression spring 66, which urges the clamp 63 toward the block 60. Further compression springs 67 are provided in a recess in each locking foot 62 to drive a plunger 68 against the back of the block 60 to hold the front of the block 60 against the front surface of the bar 50.

Figure 1A:
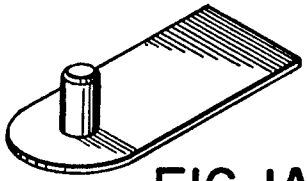
FIG. 1A is an isometric view of a flexographic plate registration pin for use as a guide with the apparatus of FIG. 1.
Figure 4:
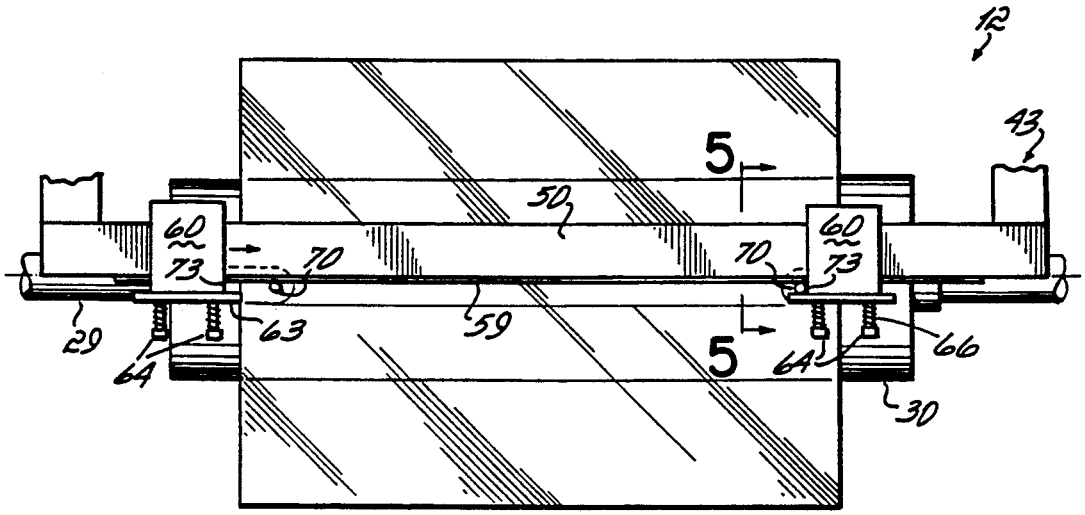
FIG. 4 is a top view of a portion of the apparatus of FIG. 1 illustrating the setting of pin guide holders with the template of FIG. 3.
Figure 5:
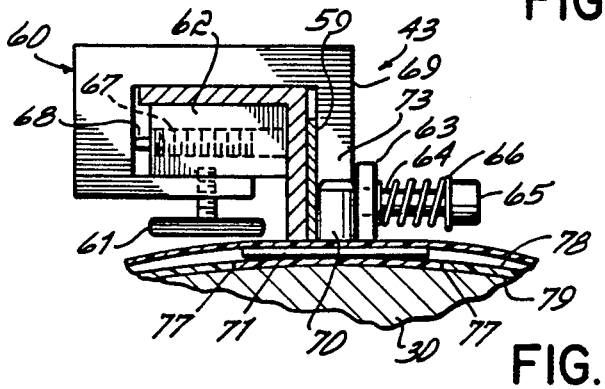
FIG. 5 is a cross sectional view of a pin guide holder along the line 5—5 of FIG. 4.
Figure 6:
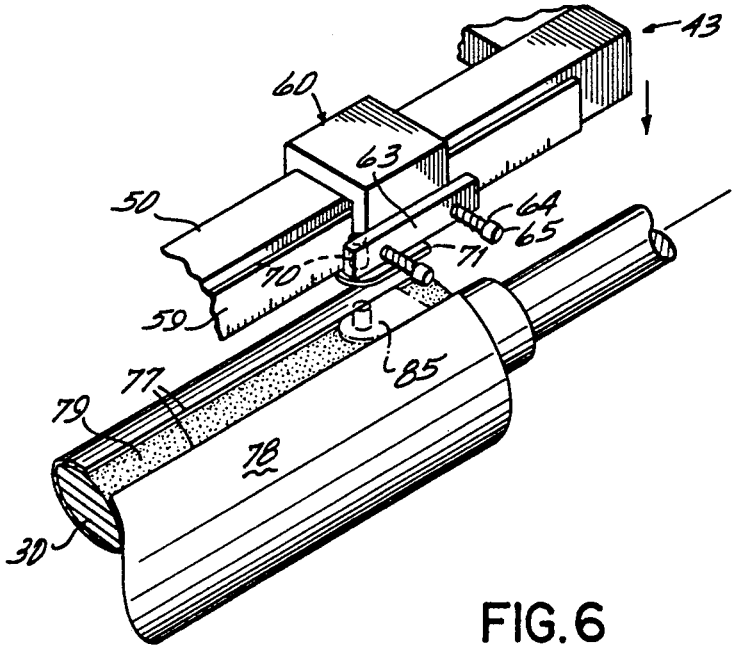
FIG. 6 is an isometric view of a portion of the apparatus of FIG. 1 illustrating the guide bar positioned for the placement of guide pins onto the surface of a print cylinder prepared therefor.

The blocks 60 each have a front wall 69 dimensioned to hold between the scale 59 on the front of the bar 50 and the clamps 63 a registration pin 70, illustrated in FIG. 1A. A registration pin 70 is fixed and oriented perpendicular to a flat sheet metal tab 71. The thickness or diameter of pins 70 is more than one and less than two times the thickness of the front wall of the blocks 60 so that the pin 70 will be clamped between the scale 59 and the clamp 63 in precise position against a side edge 73 of the wall 69 of the clamp 60, as illustrated in FIGS. 4–6. The pins 70 are held by the springs 66 loosely enough to be pulled from the clamped position on the bar 50 when the tabs are brought into pressure contact with and adhered or otherwise secured to the surface of a cylinder 30, as explained below.

In the preferred method of use of the apparatus 12, referring to FIG. 1, a print cylinder 30 that is one of a set of identical cylinders for use in multiple color printing on a flexographic printing press, set on the rests 16, preferably by lowering the cylinder 30 with a hoist downwardly to place the ends of its shaft 29 onto the edges 31 of the inner ones of the plates 25 and rolling the shaft to bring it into the notches 32, allowing the shaft 29 to rest upon the surfaces of the rollers 27, as illustrated in FIG. 2. This brings the axis of the shaft 29 into general alignment on the axis 17. Then, one or both of the knobs 38 is tightened to bring the disks 39 toward each other to bear against the opposite ends of the shaft 29 to clamp and lock the cylinder 30 axially in a fixed position on the base 13. The cylinder 30 may also be circumferentially aligned and indexed to a particular angular position, which is particularly desirable where multiple plates are to be placed in predetermined relationships to each other on the same cylinder.

Next, the bar 50 is lowered to bring the lower edge of the scale 59 into close proximity to the surface of the cylinder 30 and a pair of horizontal score marks or slits 77 are made in backing tape 78 that covers a layer of backing tape 79 surrounding the surface of the cylinder 30, parallel to the axis 17, and about one inch apart along the upwardly facing side of the cylinder 30 on which the centerline of a printing plate or mat will be placed.

Figure 3:
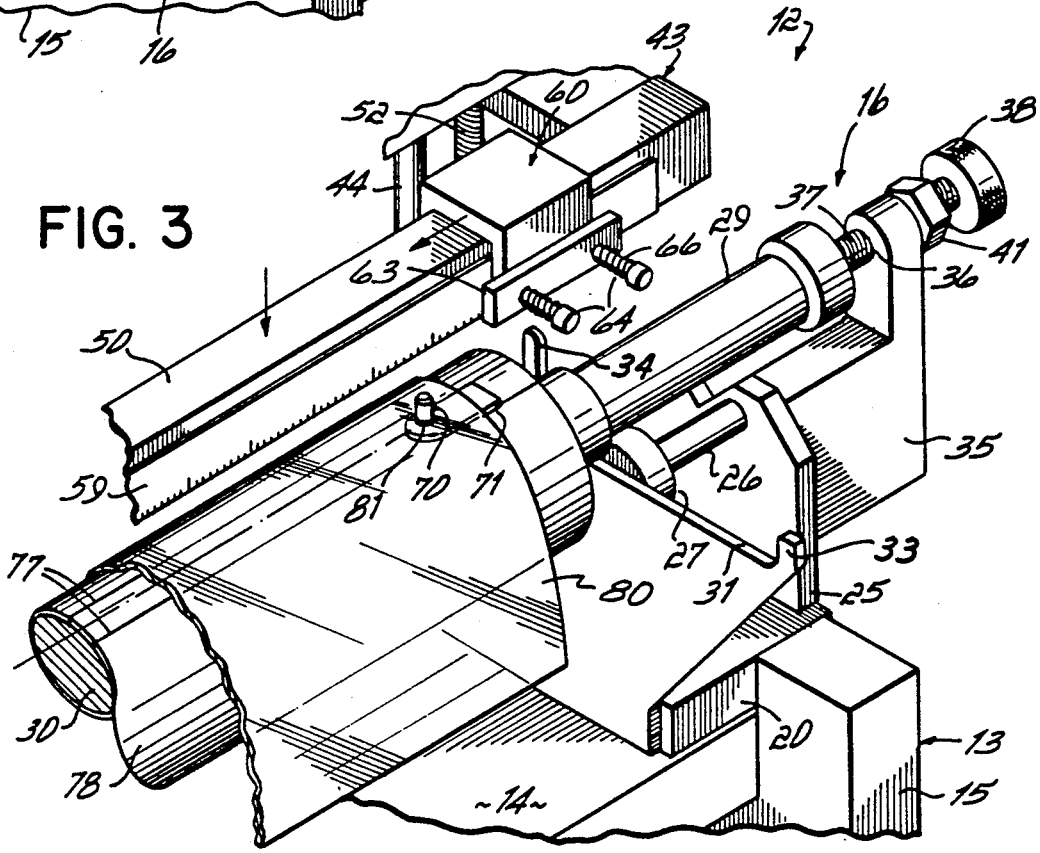
FIG. 3 is an isometric view of a portion of the apparatus of FIG. 1 illustrating the use of a pin positioning template.

Then, as illustrated in FIG. 3, a template 80 is placed over the cylinder 30. The template 80, as illustrated in FIG. 4, has a pair of registration holes 81 (not shown) aligned along an approximate centerline 82 thereof. The holes 81 in the template 80 are spaced a distance precisely equal to the distance between two registration holes in each of the printing plates 90 (FIGS. 7-10) of a set of plates, and preferably was used for the location of the holes in the plates. The template 80 is set onto the cylinder 30 a pair of pins 70 inserted in the holes 81 thereof, with the tabs 71 against the surface of the cylinder 30, and the pins 70 forward of a vertical plane that contains the front surface and scale 59 of the bar 50 and the axis 17.

The bar 50 is then lowered by momentary depression of the DOWN one of the buttons 57 to energize the motor 46 and bring the lower edge of the bar 50 to a lower rest position spaced ⅛ inch, for example, from the upper surface of the cylinder 30, with the blocks 60 to one side or the other of the pins 70. When the bar 50 stops in the lowered position, the template 80 is slid rearwardly on the surface of the cylinder 30 until the pins 70 are in contact with the scale 59 of the bar 50, as illustrated in FIG. 4. If desirable, the template may be positioned transversely so that the pins are at a particular position on the scale 59.

When the pins 70 are in their desired positions and against the scale 59 of the bar 50, the blocks 60 are slid horizontally along the bar until the pins 70 are trapped between the clamp 63 and the scale 59, and against the side 73 of the front wall 69 of the blocks 60, as illustrated with the rightmost clamp 60 in FIG. 4 and in FIG. 5. Both blocks 60 are so positioned and locked in place by the tightening of the locking knobs 61. Then, the template 80 is removed, pulling the pins 70 from the blocks 60, and the pins 70 are removed from the holes 81 of the template 80 and reinserted in their clamped positions back on the blocks 60, as illustrated in FIG. 6. Then, the one inch strip of backing tape 78 between the slits 77 is removed, exposing the adhesive of the tape 79 below, and the bar is lowered so as to bring the bottoms of the tabs 71 of the pins 70 against the adhesive along the one inch strip, adhering them thereto. Then the bar 50 is raised, leaving the pins 70 stuck onto the surface of the cylinder 30 along a line parallel to the axis 17 and spaced apart exactly the distance between the holes 81 in the template 80. One of the pins 70 so positioned is illustrated in phantom lines at a position 85 in FIG. 6.

Figure 7:
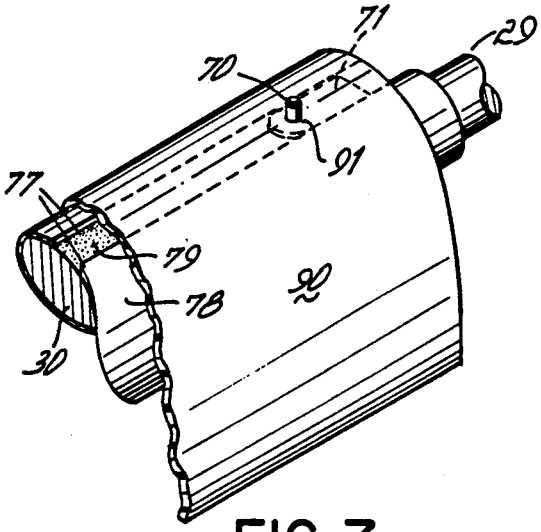
FIG. 7 is an isometric view of a portion of the apparatus of FIG. 1 illustrating the initial positioning and orientation of a printing mat onto a print cylinder.
Figure 8:
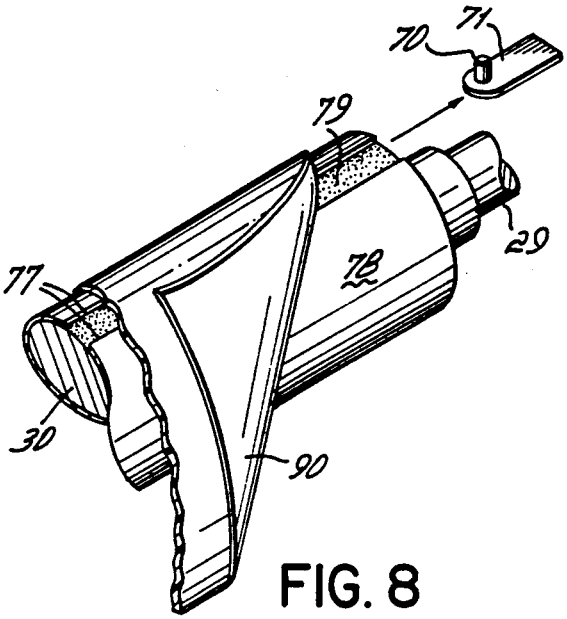
FIG. 8 is an isometric view illustrating the removal of the guide pins form the print cylinder after the printing mat is initially positioned thereon.
Figure 9:
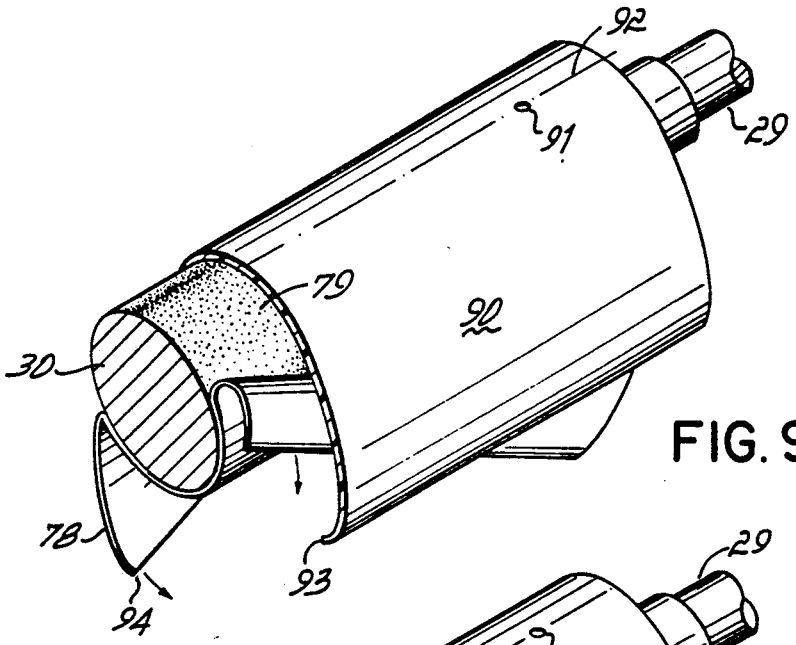
FIG. 9 is an isometric view of a portion of the print cylinder of FIGS. 2–4 and 6–8 illustrating the printing mat being secured to the print cylinder.
Figure 10:
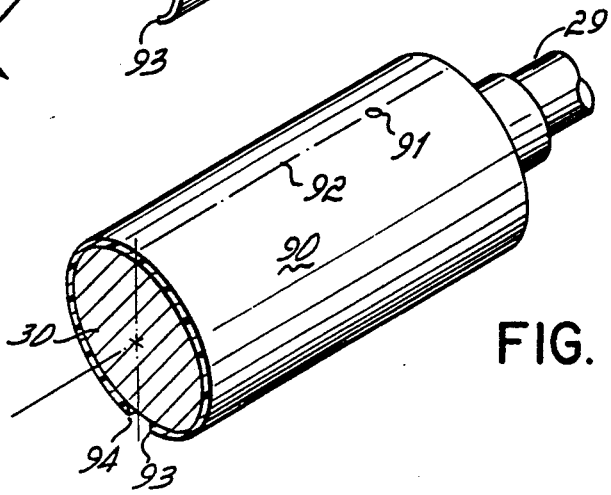
FIG. 10 is an isometric view similar to FIG. 9 illustrating the printing mat fully secured to the print cylinder.

Then, the printing plate or flexographic mat 90, which has a pair of holes 91 spaced at the same distance from each other as the holes 81 of the template 80 and along an approximate centerline 92 thereof, is set onto the cylinder 30 with its holes 91 over the pins 70, and the mat is pressed against the one inch strip of adhesive on the centerline 92 of the mat 90 and near the center of the width of the cylinder 30, enough along the strip to prevent the mat from thereafter moving, as illustrated in FIG. 7. Then mat 90 is lifted near the edges thereof and the pins 70 are removed from the adhesive on the surface of the cylinder 30, as illustrated in FIG. 8, and the mat 90 is then pressed against the adhesive of the strip across the width of the cylinder 30. Then, the remainder of the backing paper 78 is removed from the tape 79 on the cylinder 30, as illustrated in FIG. 9, and the mat is pressed against the cylinder surface from the centerline 92 toward opposite edges 93 and 94 of the mat 90. With this step, the first of the mats 90 is properly registered for printing.

Then, the cylinder 30 on which the first of the mats 90 was mounted is removed from the apparatus 12 by loosening one of the knobs 38 on one of the rests 16, while leaving the other locked in place. The blocks 60 are also left locked in place on the bar 50. Then, the pins 70 are placed in their positions on the blocks 50, a second one of the cylinders 30 of the same set is positioned on the rests 16, aligned and locked into the same place was the first cylinder, as illustrated in FIG. 2, the backing tape 78 is slit and the one inch strip removed, and the pins are positioned on the second cylinder 30 as illustrated in FIG. 6. Then, the second mat 90 is secured to the second cylinder 30 as described in connection with FIGS. 7-10. This mat 90 will thus be in precise registration with the mat on the first cylinder when the two cylinders 30 are mounted on a press. Mats are registered onto the other cylinders of the same set in the same way.

When multiple plates are mounted onto the same cylinders to be registered with corresponding plates on other cylinders of the set so that multiple objects can be printed simultaneously, the corresponding plates are transversely registered using the scale 59, or preferably, multiple block sets 60 are used, or one set of plates is set on all cylinders and before the next set of plates is mounted. These different plates are placed circumferentially by indexing the positions of the cylinders around the axis 17.

The above description is of one preferred embodiment of the invention. Those skilled in the art will appreciate that modifications of the above and additions thereto may be made without departing from the principles of the invention. For example, certain advantages of the invention can be realized without using pins that are removably held to the pin guides or registration blocks on the bar and transferred and removably secured to the cylinders. Registration elements and mat engaging structure other than pin holders and pins may register the mats. Registration elements may also alternatively remain on the blocks on the structure such as the bar, to register the mats exactly in position to be secured to the cylinders without removal of the pins for the bar. This would be accomplished by bringing the mat with the bar or other such structure against the cylinder to which it is to be secured, for example, thereby pressing it against the exposed tape. Such a bar may be brought up against the cylinder from below so that the mat can be carried face down by the bar and raised against the surface of the cylinder to be secured.

Accordingly, the following is claimed:

1. A method of mounting a flexible printing plate to a printing press cylinder comprising the steps of:

providing a first photopolymer printing plate having two opposite edges, two opposite ends, and two mounting holes therein, one near each of the opposite edges, the holes being spaced a predetermined distance apart along an approximate centerline of the first plate that is generally parallel to and approximately midway between the opposite ends of the first plate;

supporting a first printing cylinder on a horizontal axis with a plate supporting cylindrical surface thereof surrounding the axis at a fixed radius therefrom;

locating a pair of registration pin holders spaced the predetermined distance from each other on a member adjacent the first cylinder and spaced from each other the predetermined distance along a reference line that is parallel to the axis of the first cylinder;

positioning a pair of registration pins, each in one of the holders and spaced the predetermined distance apart along the reference line;

translating the member toward the axis of the first cylinder to carry the reference line approximately against, and the pins into contact, with the surface of the first cylinder each at a respective one of a pair of points axially spaced from each other the predetermined distance along a first axial line on the surface of the first cylinder that is parallel to and between the reference line and the axis;

removably securing the pins to the surface of the first cylinder at the respective points;

moving the member away from the surface of the first cylinder;

placing the first plate on the surface of the first cylinder with the holes thereof centered on the pins;

partially securing the first plate to the surface of the first cylinder along the approximate centerline of the first plate with the approximate centerline thereof in registration with the first axial line on the surface of the first cylinder;

removing the pins from the surface of the first cylinder;

further securing the first plate to the surface of the first cylinder from the first mounting line to the opposite ends of the first plate.

2. The method of claim 1 further comprising the steps of:

providing a second photopolymer printing plate having two opposite edges, two opposite ends, and two mounting holes therein near each of the opposite edges, the holes being spaced the predetermined distance apart along an approximate centerline of the second plate that is generally parallel to and approximately midway between the opposite ends of the second plate;

removing the first cylinder from the support;

supporting a second printing cylinder on the axis with a plate supporting surface thereof surrounding the axis at the fixed radius therefrom;

repositioning the registration pins in the holders;

translating the member toward the axis of the second cylinder to carry the reference line approximately against, and the pins into contact with, the surface of the second cylinder, each at a respective on of a pair of points axially spaced from each other the predetermined distance along a second axial line on the surface of the second cylinder that is parallel to and between the reference line and the axis;

removeably securing the pins to the surface of the second cylinder at the respective points;

moving the member away from the surface of the second cylinder;

placing the second plate on the surface of the second cylinder with the holes thereof centered on the pins;

partially securing the second plate to the surface of the second cylinder along the approximate centerline of the second plate with the approximate centerline thereof in registration with the second axial line;

removing the pins from the surface of the second cylinder;

further securing the second plate to the surface of the second cylinder from the second mounting line to the opposite ends of the second plate;

whereby a plurality of flexible printing plates are registered with respect to each other on a respective plurality of printing cylinders for multiple color printing therewith.

3. The method of claim 2 further comprising the steps of:

removing the second cylinder from the support;

installing the first and second cylinders with the first and second plates respectively mounted thereon in a printing press;

printing a first color image onto a substrate with the first plate; and overprinting a color image onto the substrate with the second plate in registration with the first color image to produce a precisely registered multiple color image;

whereby a multiple color image is thereby printed on the substrates.

4. The method of claim 1 wherein:

the first plate providing step includes the substeps of providing a template having a pair of guides thereon spaced from each other the predetermined distance, forming the holes in the plate with the guides of the template; and the locating step includes the substep of locating the pair of pin holders with the guides of the template.

5. The method of claim 4 wherein:

the locating step includes the substep of positioning the pins at the predetermined distance in the guides of the template, locating the pair of pin holders with the pins positioned in the guides of the template.

6. A method of mounting a plurality of printing plates of a set onto a corresponding plurality of printing press cylinders of a printing press in corresponding registered positions with respect to each other for the sequential printing of multicolor images therewith, the method comprising the steps of:

supporting a first printing press cylinder at a fixed position on an axis;

providing, on each of a plurality of printing plates, at least two registration indicia spaced a predetermined distance apart along an approximate centerline thereof, each plate having a printable image thereon at a predetermined position with respect to the indicia;

locating at least two registration elements adjacent the printing surface of the supported cylinder and spaced the predetermined distance apart;

establishing, with the registration elements, two points, at respective registration positions relative to the axis, spaced from each other the predetermined distance and located on a mounting line on the surface of the first cylinder when the first cylinder is supported at the fixed position on the axis;

aligning the registration elements with the indicia on a first plate of the plurality of plates;

respectively positioning the indicia of the first plate over the elements at the points on the surface of the first cylinder and over the cylinder;

securing to the surface of the first cylinder, along the mounting line thereof, a portion of the first plate, along the approximate centerline thereof; then, securing the remainder of the first plate, progressing from the centerline to opposite ends thereof, to the surface of the first cylinder;

supporting a second printing press cylinder of the plurality of cylinders at the fixed position on the axis such that the two points are spaced from each other the predetermined distance and are located on a mounting line on the surface of the second cylinder when the second cylinder is supported at the fixed position on the axis;

aligning the registration elements with the indicia of a second plate of the plurality of plates;

respectively positioning the indicia of the second plate over the elements at the points on the surface of the second cylinder and over the cylinder;

securing to the surface of the second cylinder, along the mounting line thereof, a portion of the second plate, along the approximate centerline thereof; then, securing the remainder of the second plate, progressing from the centerline to opposite ends thereof, to the surface of the second cylinder;

whereby the printing plates are mounted to corresponding printing press cylinders in corresponding registered positions with respect to each other for sequential printing of multicolor images therewith.

7. The method of claim 6 further comprising the steps of:

recording the fixed position of the first cylinder on the axis; and the second cylinder supporting step includes the step of positioning the second cylinder on the axis in response to the recorded fixed position.

8. The method of claim 7 wherein:

the fixed position recording step includes the step of setting an axial stop with respect to an end of the first cylinder; and the second cylinder positioning step includes the step of positioning an end of the second cylinder that corresponds to the end of the first cylinder with respect to the axial stop.

9. The method of claim 7 wherein:

the fixed position recording step includes the step of setting the first cylinder at a circumferential index position on the axis; and the second cylinder positioning step includes the step of setting the second cylinder to the circumferential index position on the axis.

10. A method of mounting a plurality of printing plates of a set onto a corresponding plurality of printing press cylinders of a printing press in corresponding registered positions with respect to each other for the sequential printing of multicolor images therewith, the method comprising the steps of:

supporting a first printing press cylinder at a fixed position on an axis;

providing, on each of a plurality of printing plates, at least two registration indicia spaced a predetermined distance apart along an approximate centerline thereof, each plate having a printable image thereon at a predetermined position with respect to the indicia;

locating at least two registration elements adjacent the printing surface of the supported cylinder and spaced the predetermined distance apart;

establishing, with the registration elements, two points, at respective registration positions relative to the axis, spaced from each other the predetermined distance and located on a mounting line on the surface of the first cylinder when the first cylinder is supported at the fixed position on the axis;

aligning the registration elements with the indicia on a first plate of the plurality of plates;

respectively positioning, with the elements, the indicia of the first plate at the points on the surface of the first cylinder and securing to the surface of the first cylinder, along the mounting line thereof, a portion of the first plate, along the approximate centerline thereof; then, securing the remainder of the first plate, progressing from the centerline to opposite ends thereof, to the surface of the first cylinder;

supporting a second printing press cylinder of the plurality of cylinders at the fixed position on the axis such that the two points are spaced from each other the predetermined distance and are located on a mounting line on the surface of the second cylinder when the second cylinder is supported at the fixed position on the axis;

aligning the registration elements with the indicia of a second plate of the plurality of plates;

respectively positioning, with the elements, the indicia of the second plate at the points on the surface of the second cylinder and securing to the surface of the second cylinder, along the mounting line thereof, a portion of the second plate, along the approximate centerline thereof; then, securing the remainder of the second plate, progressing from the centerline to opposite ends thereof, to the surface of the second cylinder;

whereby the printing plates are mounted to corresponding printing press cylinders in corresponding registered positions with respect to each other for sequential printing of multicolor images therewith;

the registration element locating step including the steps of positioning a bar parallel to the axis, sliding at least one of the elements along an infinite plurality of possible element positions on the bar, and locking the elements at respective ones of the possible element positions that are spaced the predetermined distance apart; and the point establishing step and the indicia positioning steps including the step of translating the bar with respect to the axis to bring the registration elements into approximate contact with the surface of the first cylinder at the two points.

11. The method of claim 10 wherein:

the registration element locating step includes the step of positioning a gage against the bar and spacing the elements the predetermined distance apart therewith.

12. The method of claim 11 wherein:

the indicia providing step includes the step of forming two holes in each of the plates and forming the printable image thereon at positions determined with the gage.

13. An apparatus for mounting flexographic printing plates to printing press cylinders, wherein each plate has a printable image formed thereon in the same fixed relation to a centering line through the approximate center of the image, each cylinder having a cylindrical plate supporting surface and a shaft both centered on an axis thereof, the apparatus comprising:

a cylinder support for supporting a cylinder by its shaft thereon;

means for fixing the position of a cylinder supported on the support in relation to the support;

a track mounted on the support and oriented parallel to the axis of a cylinder supported on the support;

at least two registration elements mounted on the track, at least one of which is axially moveable along the track among an infinite plurality of positions;

means releasably carried by each of the registration elements and transferable therefrom to the surface of the cylinder for engaging the plate at a respective point on the centering line of the image to orient the centering line of the image parallel to the axis of the cylinder at the surface of the cylinder;

the track being moveable toward and away from the axis of a cylinder supported on the support, to present the engaging means and the points on the centering line against the surface of the cylinder each to a unique location on the surface of the cylinder.

14. The apparatus of claim 13 wherein:

the registration elements each include a pin holder slidable on the track parallel to the axis of a cylinder mounted on the support and each including a lock connected between the respective element and the track for selectively fixing the element in any position along a length of the track;

each of the engaging means includes a registration pin dimensioned to fit into a hole at the respective registration point on the centering line of the image to orient;

the track is moveable toward and away from the axis of a cylinder supported on the support, to present each of the pins at a respective one of the unique locations for registering the plate with the holes thereof at the unique locations and with the centering line extending between the locations for the securing of the plate in a registered position on the surface of the cylinder beginning along the centering line thereof.

15. The apparatus of claim 13 wherein:

the cylinder support includes a pair of shaft end rests for rotatably supporting an end of the shaft of the cylinder supported on the support;

the means for fixing the position of a cylinder supported on the support in relation to the support includes adjustable means on the rest for setting the axial position of the shaft on the support.

16. The apparatus of claim 13 wherein:

the cylinder support includes a pair of shaft end rests for rotatably supporting an end of the shaft of the cylinder supported on the support;

the means for fixing the position of a cylinder supported on the support in relation to the support includes adjustable indexing means for setting the circumferential position of the shaft on the support.

17. An apparatus for mounting flexographic printing plates to printing press cylinders, wherein each plate has a printable image formed thereon in the same fixed relation to a centering line through the approximate center of the image, each cylinder having a cylindrical plate supporting surface and a shaft both centering on an axis thereof, the apparatus comprising:

a cylinder support for supporting a cylinder by its shaft thereon;

means for fixing the position of a cylinder supported on the support in relation to the support;

a track mounted on the support and oriented parallel to the axis of a cylinder supported on the support;

at least two registration elements mounted on the track, at least one of which is axially moveable along the track among an infinite plurality of positions;

means carried by each of the registration elements for engaging the plate at a respective point on the centering line of the image to orient the centering line of the image parallel to the axis of the cylinder;

the track being moveable toward and away from the axis of a cylinder supported on the support, to present the engaging means and the points on the centering line against the surface of the cylinder each to a unique location on the surface of the cylinder;

the cylinder support including a pair of shaft end rests for rotatably supporting an end of the shaft of the cylinder supported on the support;

the means for fixing the position of a cylinder supported on the support in relation to the support including adjustable means on the rest for setting the axial position of the shaft on the support;

the registration elements each including a pin holder slidable on the track parallel to the axis of a cylinder mounted on the support and each including a lock connected between the respective element and the track for selectively fixing the element in position on the track, each of the pin holders including means for releasably holding thereagainst a registration pin;

each of the engaging means including a registration pin releasably engagable by the pin holder and dimensioned to fit into a hole at the respective registration point on the centering line of the image, each of the pins having a flat mounting surface thereon securable to the surface of a cylinder; and the track being moveable toward and away from the axis of a cylinder supported on the support, to secure the pins to the surface of the cylinder at the corresponding one of the unique locations, and moveable away from the surface of the cylinder to cause the pins to be released from the holders.

18. An apparatus for mounting flexographic printing plates to printing press cylinders, wherein each plate has a printable image formed thereon in the same fixed relation to a centering line through the approximate center of the image, each cylinder having a cylindrical plate supporting surface and a shaft both centered on an axis thereof, the apparatus comprising:

a cylinder support for supporting a cylinder by its shaft thereon;

means for fixing the position of a cylinder supported on the support in relation to the support;

a track mounted on the support and oriented parallel to the axis of a cylinder supported on the support;

at least two registration elements mounted on the track, at least one of which is axially moveable along the track among an infinite plurality of positions;

means carried by each of the registration elements for engaging the plate at a respective point on the centering line of the image to orient the centering line of the image parallel to the axis of the cylinder;

the track being moveable toward and away from the axis of a cylinder supported on the support, to present the engaging means and the points on the centerline line against the surface of the cylinder each to a unique location on the surface of the cylinder;

the registration elements each includes a pin holder slidable on the track parallel to the axis of a cylinder mounted on the support and each including a lock connected between the respective element and the track for selectively fixing the element in any position along a length of the track;

each of the engaging means includes a registration pin dimensioned to fit into a hole at the respective registration point on the centering line of the image to orient;

the track is moveable toward and away from the axis of a cylinder supported on the support, to present each of the pins at a respective one of the unique locations for registering the plate with the holes thereof at the unique locations and with the centering line extending between the locations for the securing of the plate in a registered position on the surface of the cylinder beginning along the centering line thereof;

each of the pins having a mounting surface thereon securable to the surface of a cylinder; and the track being moveable toward and away from the axis of a cylinder supported on the support, to secure the pins to the surface of the cylinder at the corresponding one of the unique locations, and moveable away from the surface of the cylinder to cause the pins to be released from the holders.

19. The apparatus of claim 18 wherein:

the cylinder support includes a pair of shaft end rests for rotatably supporting an end of the shaft of the cylinder supported on the support; and at least one of the rests is moveable on the support toward and away from the other of the rests to accommodate cylinder shafts of differing lengths.

20. An apparatus for mounting flexographic printing plates to printing press cylinders, wherein each plate has a printable image formed thereon in the same fixed relation to a centering line through the approximate center of the image, each cylinder having a cylindrical plate supporting surface and a shaft both centered on an axis thereof, the apparatus comprising:

a cylinder support for supporting a cylinder by its shaft thereon;

means for fixing the position of a cylinder supported on the support in relation to the support;

a track mounted on the support and oriented parallel to the axis of a cylinder supported on the support;

at least two registration elements mounted on the track, at least one of which is axially moveable along the track among an infinite plurality of positions;

means carried by each of the registration elements for engaging the plate at a respective point on the centering line of the image to orient the centering line of the image parallel to the axis of the cylinder;

the track being moveable toward and away from the axis of a cylinder supported on the support, to present the engaging means and the points on the centering line against the surface of the cylinder each to a unique location on the surface of the cylinder;

means for moving the track toward and away from the surface of a cylinder mounted on the support;

a proximity sensor carried by the track for detecting the proximity of the track to the surface of the cylinder and generating a signal in response thereto; and means connected to the track moving means for stopping the track a predetermined small distance from the surface of the cylinder in response to the signal from the sensor.

* * * * *